US006799689B2

(12) United States Patent
Langtry

(10) Patent No.: US 6,799,689 B2
(45) Date of Patent: Oct. 5, 2004

(54) SHELVING DISPLAY RACK

(75) Inventor: David Langtry, Port Coquitlam (CA)

(73) Assignee: Patent Applied Technology, Winnipeg (CA)

( * ) Notice: Subject to any disclaimer, the term of this patent is extended or adjusted under 35 U.S.C. 154(b) by 0 days.

(21) Appl. No.: 10/082,344

(22) Filed: Feb. 26, 2002

(65) Prior Publication Data

US 2003/0160011 A1 Aug. 28, 2003

(51) Int. Cl.[7] ..... A47F 7/00

(52) U.S. Cl. ..... 211/59.2; 211/187; 211/134

(58) Field of Search ..... 211/181.1, 186, 211/187, 59.2, 134, 153, 189, 190, 151, 175, 90.01–90.04, 150; 312/351, 35; 108/147.11, 147.16, 155, 106, 107, 109, 110, 144.11, 147.12, 147.15, 147.17, 6, 182, 193; 248/454, 455, 235, 241–243, 240.2, 249, 250; 280/79.3

(56) References Cited

U.S. PATENT DOCUMENTS 2,932,408 A * 4/1960 Jacobson ..... 211/134
3,085,694 A * 4/1963 Jones ..... 211/134
3,086,660 A * 4/1963 Steele ..... 108/161
3,149,727 A * 9/1964 Magers ..... 211/186
3,225,939 A * 12/1965 Braun ..... 211/186
3,435,958 A * 4/1969 Chesley ..... 211/133.2
3,587,483 A * 6/1971 Konstant ..... 108/157.13
3,834,724 A * 9/1974 Trubiano ..... 280/33.996
3,894,634 A * 7/1975 Gotham et al. ..... 211/150
3,915,097 A * 10/1975 Young, Jr. ..... 108/6
3,986,462 A * 10/1976 Heft ..... 108/188
4,034,683 A * 7/1977 DiCenzo ..... 108/107
4,099,735 A * 7/1978 Becker, III ..... 280/79.3
4,231,301 A * 11/1980 Barrineau, III ..... 108/146
4,317,523 A * 3/1982 Konstant et al. ..... 211/187
4,790,707 A * 12/1988 Magretta et al. ..... 414/276
4,972,783 A * 11/1990 Crissman et al. ..... 108/107
5,048,699 A * 9/1991 Trevaskis ..... 211/59.2
5,160,051 A * 11/1992 Bustos ..... 211/59.2
5,181,653 A * 1/1993 Foster et al. ..... 236/49.3
5,271,337 A * 12/1993 Kolvites et al. ..... 108/107
5,299,698 A * 4/1994 Gay ..... 211/133.2
5,607,068 A * 3/1997 Coretti et al. ..... 211/59.2
5,718,441 A * 2/1998 Kern et al. ..... 280/79.3
5,743,412 A * 4/1998 Noble ..... 211/59.2
5,785,189 A * 7/1998 Gollob et al. ..... 211/187
5,992,651 A * 11/1999 Shaw et al. ..... 211/59.2
6,050,428 A * 4/2000 Hollander ..... 211/186
6,123,209 A * 9/2000 Tseng ..... 211/186
6,132,158 A * 10/2000 Pfeiffer et al. ..... 414/276
6,158,600 A * 12/2000 Ferrucci et al. ..... 211/90.02
6,273,276 B1 * 8/2001 Upton et al. ..... 211/59.2
6,302,284 B1 * 10/2001 Zonshin ..... 211/187
6,328,170 B1 * 12/2001 Lee ..... 211/59.2
6,405,880 B1 * 6/2002 Webb ..... 211/59.2

* cited by examiner

*Primary Examiner*—Jennifer E. Novosad
(74) *Attorney, Agent, or Firm*—Adrian D. Battison; Michael R. Williams; Ryan W. Depuis

(57) ABSTRACT

A shelving rack includes a frame structure including two generally vertical rear legs and two generally vertical front legs and a plurality of shelves formed of welded wire mesh arranged one above the next with a width substantially equal to the width of the rack and a depth between a front edge and a rear edge substantially equal to but greater than the depth of the rack. Each shelf is supported at the front edge either on a wire of the shelf attached across between the front legs or on a transverse beam of the frame so the weight from the front edge is carried by the front legs. Each shelf is inclined upwardly and rearwardly from the front edge toward the rear edge which is elevated with each shelf having an element forming part of a rear stiffener thereof at the rear edge in engagement with a respective one of the rear legs or a transverse beam across the rear legs.

8 Claims, 8 Drawing Sheets

SHELVING DISPLAY RACK

FIELD OF THE INVENTION

The present invention relates to a shelving display rack.

BACKGROUND

Commonly shelves in display racks have an inclined shelf plane to allow the material to slide forwardly to the front edge. However racks of this type are often complicated and expensive. Other racks have horizontal shelves and these are widely used and utilise framing which is relatively simple and widespread. The horizontal shelf however does not feed the product to the front for best display and merchandising.

SUMMARY

It is one object of the present invention to provide an improved rack which provides in a simple construction inclined shelves for product display.

According to the present invention there is provided a shelving rack comprising:

a frame structure including two generally vertical rear legs and two generally vertical front legs with the front legs arranged at a front of the rack and spaced by a width of the rack and the rear legs arranged at the rear of the rack and spaced by the width of the rack, the front legs being spaced from the rear legs by a depth of the rack;

a plurality of shelves arranged one above the next with a width substantially equal to the width of the rack and a depth between a front edge and a rear edge substantially equal to but greater than the depth of the rack;

each shelf being supported at the front edge so the weight from the front edge is carried by the front legs;

each shelf being inclined upwardly and rearwardly from the front edge toward the rear edge which is elevated;

each shelf having an element thereof at the rear edge in frictional engagement with a front face of a respective one of the rear legs;

each front leg being connected to the respective rear leg such that the space therebetween is maintained fixed in response to pressure from the shelves tending to increase the space;

each shelf being substantially rigid between the front edge and the rear edge such that the shelf remains straight between the element and the front edge and supports the weight of the articles therebetween without bending;

each shelf being substantially rigid across the rear edge such that the shelf remains straight between the elements supports the weight of the articles therebetween without bending;

such that each shelf is supported in inclined position solely by its support at the front edge and its frictional engagement with the rear legs holding the rear edge in elevated position against downward movement.

Preferably the angle of inclination is sufficient that the articles on the shelf slide forwardly to the front edge.

Preferably the shelves are formed of wire.

Preferably there is provided a rear stiffener member extending across the shelf adjacent the rear edge.

In one preferred arrangement, the rear stiffener member includes a flat surface arranged at an angle on the shelf to lie in a common plane with the front face of the rear leg. The rear stiffener member can be formed of a flat bar or a member with the legs of the V-shape welded at the top to the shelf structure. In this arrangement, the elements of the shelf engaging the rear legs are formed as parts of the stiffener member.

Preferably the front and rear leg are held together at the required spacing by braces interconnecting the legs.

In one arrangement, the front edge is supported solely on the front legs and is substantially rigid between the front legs such that the shelf remains straight along the front edge and supports the weight of the articles therebetween without bending.

In another arrangement, the front edge is supported on a rigid frame member connected across the front legs.

Preferably the shelf includes an upturned stop member to prevent the articles from sliding off the inclined shelf over the front edge.

In one arrangement, the shelf has a sheet member thereon defining a low friction surface to allow the articles to slide and the sheet member may have an upturned front edge to prevent the articles from sliding off the inclined shelf over the front edge.

In one arrangement the shelf is formed by primarily from wires extending from front to rear with a rear stiffener member, a front wire and at least one additional transverse wire.

In another arrangement the shelf is formed from wire mesh supported by front to rear support members extending from a transverse support rail at the front edge to a stiffener member of the shelf at the rear edge.

In one preferred arrangement, the front edge of the shelf includes a wire which is connected at its ends to respective one of the front legs so as to hold the front legs together.

According to a second aspect of the invention there is provided a shelving rack comprising:

a frame structure including two generally vertical rear legs and two generally vertical front legs with the front legs arranged at a front of the rack and spaced by a width of the rack and the rear legs arranged at the rear of the rack and spaced by the width of the rack, the front legs being spaced from the rear legs by a depth of the rack;

a plurality of shelves arranged one above the next with a width substantially equal to the width of the rack and a depth between a front edge and a rear edge substantially equal to but greater than the depth of the rack;

each shelf being supported at the front edge so the weight from the front edge is carried by the front legs;

each shelf being inclined upwardly and rearwardly from the front edge toward the rear edge which is elevated;

wherein each shelf has a plastics sheet member thereon defining a low friction surface to allow the articles to slide.

Preferably the sheet member has an upturned front edge to prevent the articles from sliding off the inclined shelf over the front edge.

According to a third aspect of the invention there is provided a shelving rack comprising:

a frame structure including two generally vertical rear legs and two generally vertical front legs with the front legs arranged at a front of the rack and spaced by a width of the rack and the rear legs arranged at the rear of the rack and spaced by the width of the rack, the front legs being spaced from the rear legs by a depth of the rack;

a plurality of shelves arranged one above the next with a width substantially equal to the width of the rack and a depth between a front edge and a rear edge substantially equal to but greater than the depth of the rack;

each shelf being supported at the front edge by a front transverse shelf support beam connected across the front legs so the weight from the front edge is carried by the front legs;

each shelf having a shelf plane being inclined upwardly and rearwardly from the front edge toward the rear edge which is elevated;

each shelf being supported at the rear edge by a rear transverse shelf support beam connected across the rear legs so the weight from the rear edge is carried by the rear legs;

each of the front support beam and the rear support beam including a support receptacle for the respective edge of the shelf;

the shelf having at the rear edge a downwardly turned rear edge portion extending downwardly from the shelf plane to the rear receptacle.

Preferably the shelf includes a plurality of longitudinally spaced stiffener members each extending from the front edge to the downwardly turned rear edge portion.

Preferably each stiffened member is of reduced height at the front to engage into the receptacle of the front support beam.

Preferably each shelf is formed from wire mesh.

Preferably each shelf has a plastics sheet member thereon defining a low friction surface to allow the articles to slide.

Preferably the sheet member has an upturned front edge to prevent the articles from sliding off the inclined shelf over the front edge.

Preferably the rear support beam is located at a height above the front support beam.

BRIEF DESCRIPTION OF THE DRAWINGS

In the accompanying drawings, which illustrate an exemplary embodiment of the present invention.

DETAILED DESCRIPTION

Figure 1:
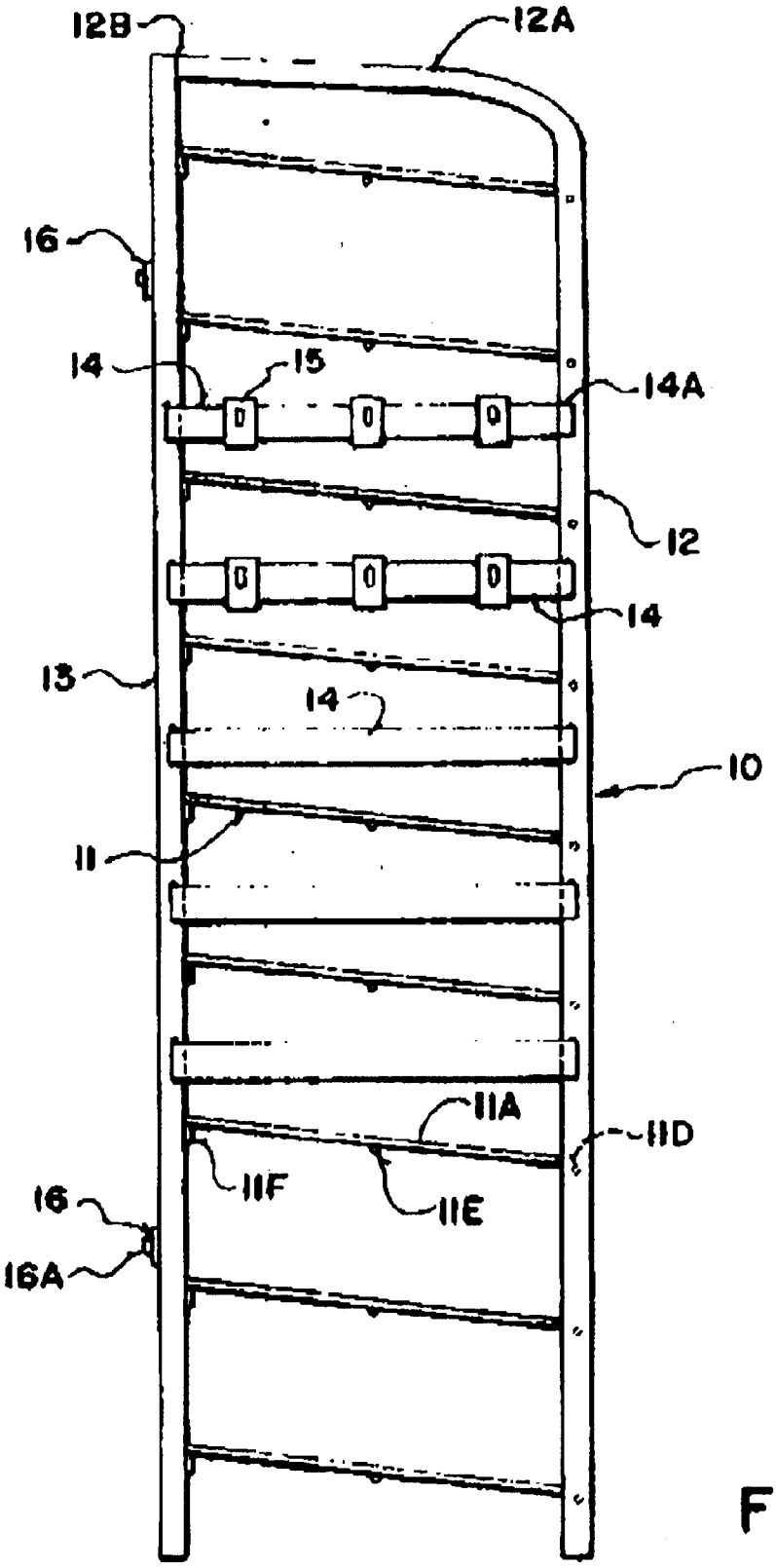
FIG. 1 is a side elevational view of a first embodiment of rack according to the present invention.

A first embodiment is shown in FIGS. 1,2, 3 and 4 and provides a stand alone rack which is intended to be accessed by customers from the front and from the sides and may be combined with a similar rack in back to back arrangement to provide an island type display in a retail store for displaying various articles of different types but primarily hardware of the type which is supplied normally in boxes.

The rack comprises a first end frame 10 and a second end frame 10A (FIG. 3) which are identical and arranged in spaced parallel position to mount a plurality of shelves 11 therebetween. The end frames 10 and 10A are opposite so that one is a mirror image of the other but the construction is substantially identical so that only one of them will be described herein.

Each of the end frames comprises a front leg 12 and a rear leg 13 which are vertical, parallel and spaced by the depth of the rack. The upper end of the front leg 12 includes a rearwardly turned top portion 12A which extends upwardly and rearwardly to a welded joint 12B at the top of the rear leg 13.

The legs 12 and 13 are connected by transverse flat straps 14 at spaced positions along the height of the legs with the straps 14 being horizontal. Each flat strap is formed of metal with a height greater than the thickness so that the rear surface of the strap at the ends of the strap lie in contact with an outer face of the legs 12 and 13 to which the strap is welded as indicated at 14A. In order to minimize the number of welds used, the straps 14 are welded only at the top edge to the outwardly facing end face of the end frame thus holding the inside face of the straps against the end frame and holding the legs of the end frame in the required spaced position against spreading of the legs.

The straps 14 are dimensioned so as to receive a conventional spring clip 15 attached thereto. Each spring clip has a channel portion 15A dimensioned to engage over the height of the strap with spring clip elements 15B extending behind the strap to clip in place onto the strap holding the channel section 15A onto the strap in fixed position. An outwardly projecting arm 15C is attached to a front face 15D of the spring clip and extends therefor away from the strap 14 to form a support for hanging elements engaged over the arm 15C. An outer end of the arm is turned upwardly to inhibit the hanging elements from falling over the outer end of the arm. Spring clips of this type are well known and conventional in the industry and are used to support generally hanging bags of items to be merchandised.

The straps 14 therefore provide two functions of holding the legs in place and also providing supports for the spring clips by which merchandising articles can be suspended on the outer side of the rack so as to be approached by a person moving toward the side of the rack. The rack therefore can be used for merchandising materials at both ends of the rack and also on the shelves as described hereinafter.

The end frames 10 and 10A are interconnected by two or more straps 16 which extend across the rear legs 13 on the rear face of those legs with the strap 16 being attached to the legs by bolts 16A which extend through suitable holes in the straps and into the rear wall of the legs.

The legs are formed from rectangular tubing so as to define a hollow interior with four walls forming flat faces at the rear, sides and front. The front legs 12 are free from fixed connection by straps similar to the straps 16 so that they are generally supported at the same spacing as the rear legs 13 but are free from separate connection therebetween.

Thus the structure of the frame is very simple in that it includes the end frames with a relatively small number of welds to form the end frames together with the strap 16 which can be supplied separately from the end frames and the structure bolted together when assembled at the used location to provide the upstanding rectangular structure of the rack.

The shelves 11 are also of a simple construction formed primarily from wires 11A which extend across the width of the shelf from a front edge 11B to a rear edge 11C. The shelf is of a width to bridge the space between the front leg 12 and the rear leg 13. The wires 11A are spaced and parallel with sufficient wires to provide structural strength for the shelf and to support elements on the shelf.

The wires 11A are interconnected by a front transverse wire 11D, a central transverse wire 11E and a rear stiffener element 11F. These three elements together with the structure of the wires 11A provides a rigid flat surface onto which the elements to be displayed can be located. As the wires 11A are presented at the upper surface of the shelf and run front to back, this allows material to slide forwardly and rearwardly on the shelf relatively easily without encountering the wires 11D and 11E together with a stiffener element 11F which are on the underside of the shelf.

In addition, the shelf includes a front face plate 11G which is welded to the front edge of the wires 11A and provides a facing plate which obscures the structure of the front edge of the shelf from viewing by a person standing in front of the rack so that the front edge of the shelf is provided an attractive appearance defined by the facing plate 11G. The facing plate 11G is shaped as a C-channel so as to receive price cards within the front facing receptacle of the channel. Thus the price cards can be inserted on the shelf adjacent to the article to be merchandised which are located on the shelf behind the facing plate. The facing plate also stands upwardly from the wires 11A so as to act as a front abutment to prevent the articles from slipping over the front edge.

Figure 2:
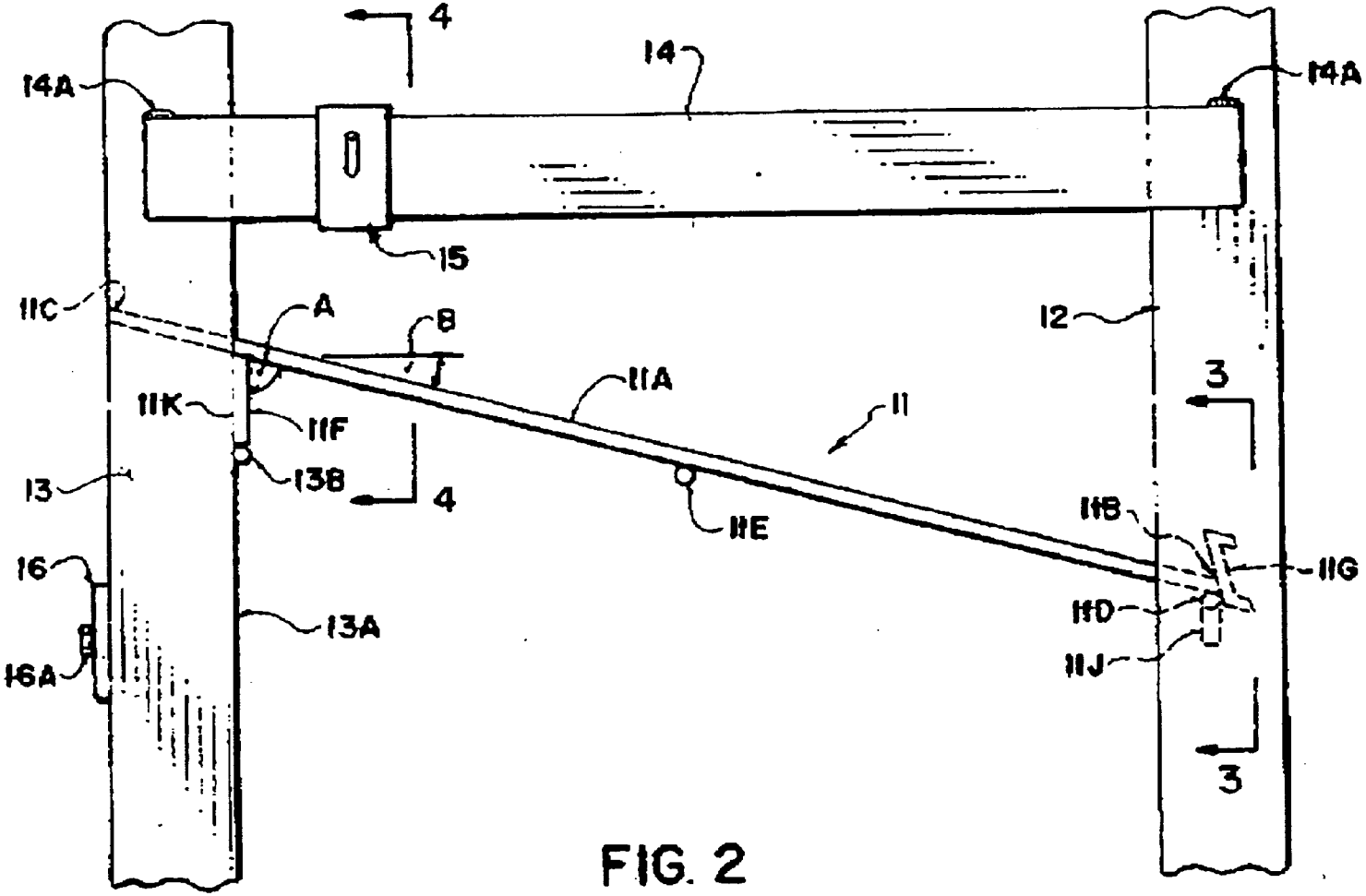
FIG. 2 is a cross sectional view of the embodiment of FIG. 1.
Figure 3:
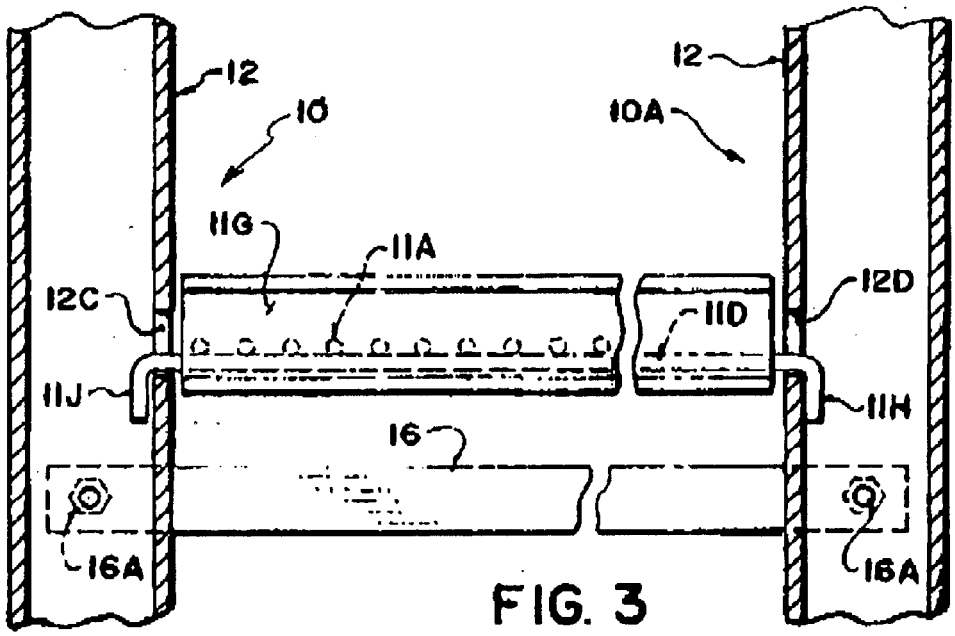
FIG. 3 is a cross sectional view along the lines 3—3 of FIG. 2.

The rear stiffener member 11F in the embodiment shown in FIG. 2 comprises a flat strap which is welded at its upper edge to the underside of the wires 11A at a position thereon spaced forwardly from the rear edge 11C. The flat strap is arranged at an angle A relative to the wires 11A which is different from 90° by an amount equal to an angle B which is the angle of inclination of the shelf relative to the horizontal. Thus the strap 11F stands vertically and extends downwardly from the underside of the shelf.

The wire 11D extends across the full width of the shelf and has turned down ends 11H and 11J which engage into holes 12C and 12D respectively in the legs 12 of the end frames 10 and 10A respectively. Thus the wire 11D extends beyond the ends of the shelf into the interior of the legs 12 and extends downwardly on the inside of the inwardly facing wall of the legs 12 so as to engage against those walls and particularly the inside surfaces thereof. Thus the wires 11D of the shelves hold the legs 12 at a predetermined spacing since the legs cannot move apart due to the engagement of the turned down wire portions 11H and 11J against the inside surface of the legs. The legs are prevented from moving toward one another by the engagement of the legs with the endmost wires 11A of the shelves.

Figure 4:
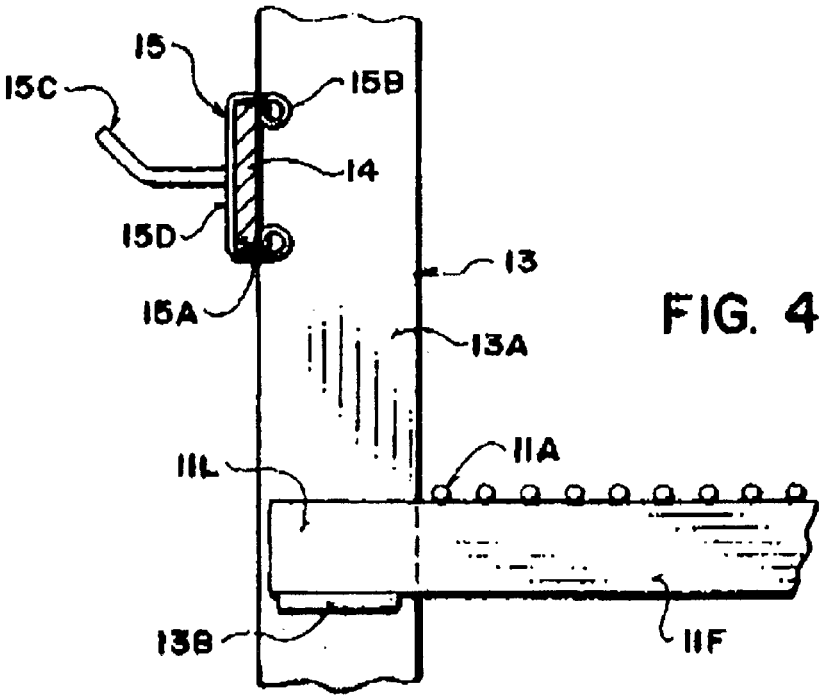
FIG. 4 is a cross sectional view along the lines 4—4 of FIG. 2.

The shelves are inclined upwardly and rearwardly as best shown in FIG. 2 at the angle B so that the rear edge 11C is raised above the front edge 11B. The spacing between the front wire 11D and the rear stiffener 11F is arranged so that, at this angle, the rear face 11K of the stiffener 11F engages a front face 13A of the rear leg in a frictional engagement. Thus the flat face 11K stands in a vertical plane which is a common plane with the front face 13A providing frictional engagement of end portions 11L with the front face 13A as best shown in FIG. 4. The shelves are sufficiently stiff so as to remain flat in a common plane and the stiffener members are sufficiently stiff so as to remain straight between the end portions 11L which project outwardly beyond the end most wire 11A. Thus the shelf is a very simple construction formed simply by the wires on the stiffeners and is held in place by the frictional engagement with the face 13A. An optional abutment 13B may be provided on the front face 13A at the required height to engage the bottom edge of the stiffener 11F although it is preferred that this optional abutment be avoided since it increases the cost and complexity of the structure. This can be achieved provided that there is sufficient frictional engagement between the rear surface 11K and the front surface 13A. The fact that the surface 11K is in a vertical plane avoids putting bending stress on the shelf structure.

Figure 5:
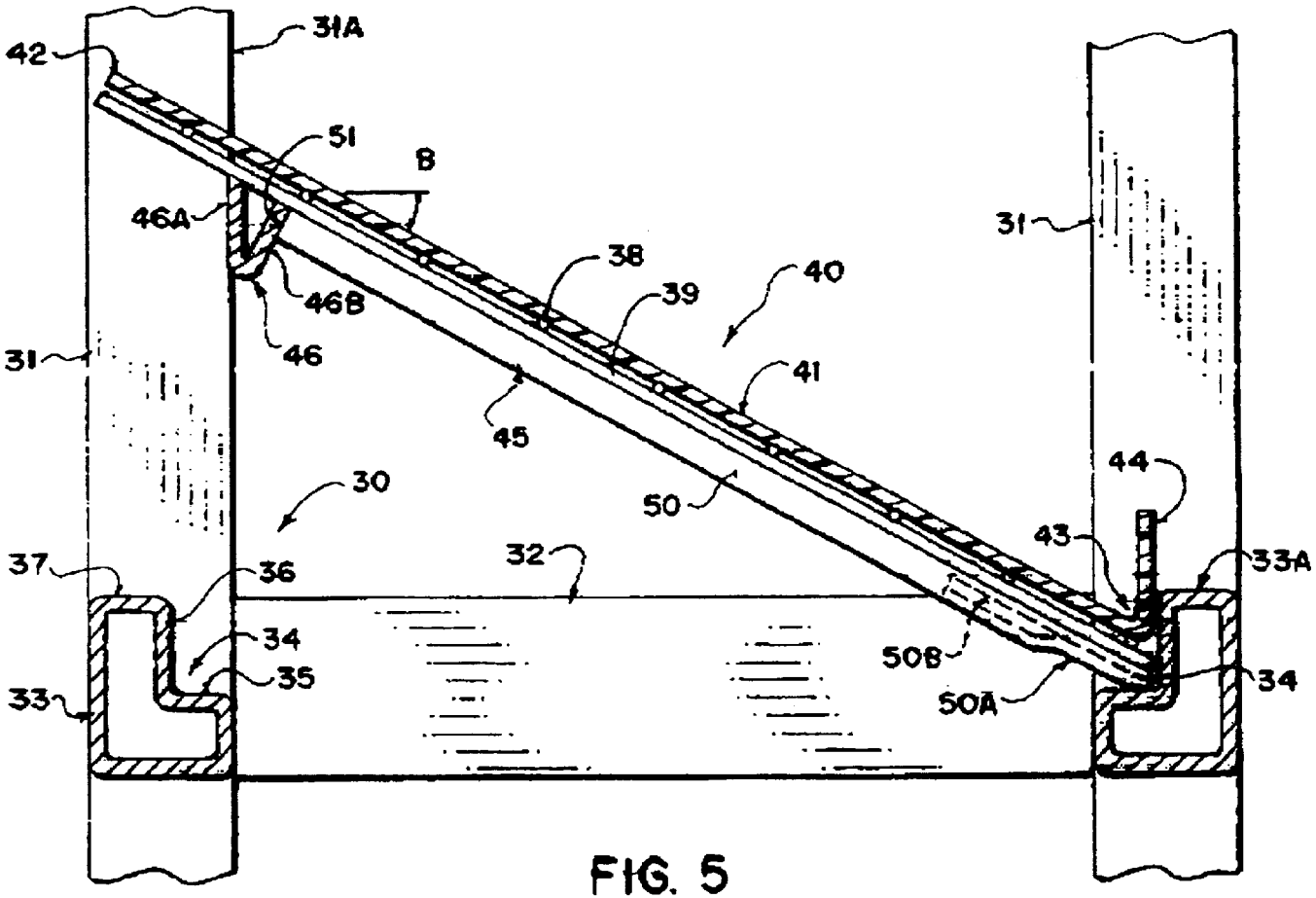
FIG. 5 is a cross sectional view similar to that of FIG. 2 showing a second embodiment.
Figure 6:
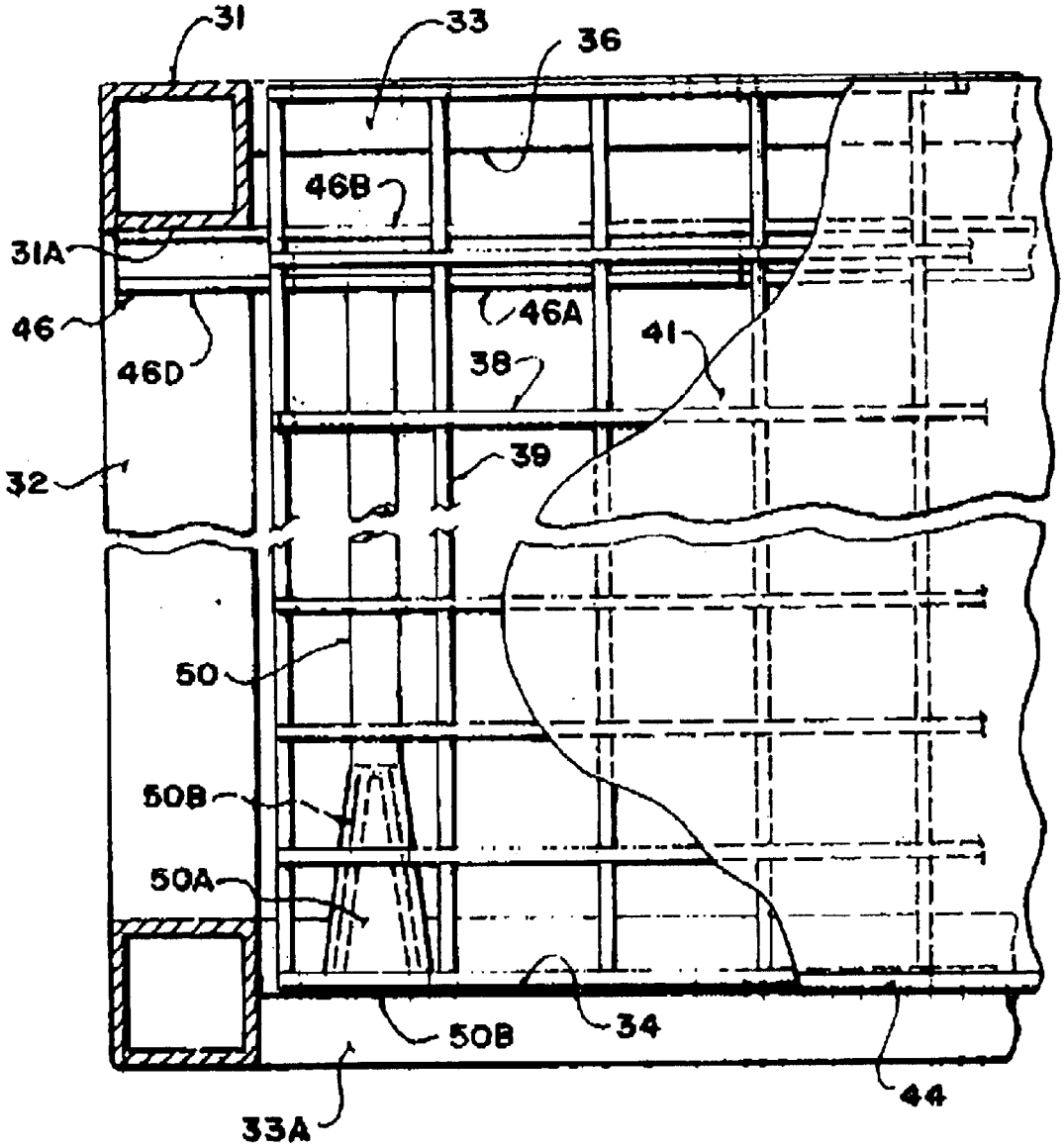
FIG. 6 is plan view of the embodiment shown in FIG. 5.

The arrangement shown in FIGS. 1 through 4 includes a frame structure which is specially constructed to co-operate with the shelf elements so as to form a complete rack. In FIGS. 5 and 6 is shown a second embodiment which utilizes basically the same principle as previously described but is intended for use with conventional racking frames generally indicated at 30. Such racking frames include vertical posts 31, horizontal interconnecting cross members 32 and longitudinal shelf support rails 33. The rails 33 are shaped with a 90° receptacle portion 34 defined in the upper inward quadrant for receiving conventionally a shelf panel. Thus the receptacle defines a horizontal surface 35 and a vertical surface 36 which butt against the shelf panel. The shelf panel can be formed conventionally of plywood or other sheet material or can conventionally be formed of wire racking formed by longitudinal and transverse wires with turned down front and rear edges which abut the surface 36 and sit on the surface 35. The front and rear turned down edges have a height of the order of 1" so as to provide stiffening at the edges and also to lift the height of the wire shelf up to the height of the top surface 37 of the shelf support beams 33.

This type of shelving is conventionally used in large box retail stores such as Home Depot and provide the horizontal shelf onto which articles to be merchandised are placed to be removed by the customer.

In the arrangement described herein, the horizontal shelf is replaced by an inclined shelf schematically indicated at 40 which utilizes the same frame structure but provides a shelf with an angle so that the displayed merchandise can slide downwardly along the top surface of the shelf to the front to be readily removed by the customer. Thus all of the articles on the shelf are displayed at the front and whenever an article is removed the remaining articles slide to the front to be properly merchandised and displayed.

In the embodiment shown, the shelf is formed from longitudinal wires 38 and transverse wires 39 welded to form a grid pattern with the transverse wires 39 extending from the front edge of the shelf at the front beam 33A to a rear edge of the shelf at the rear beam 33. In this embodiment it does not matter which of the wires is on the upper surface since the whole of the shelf structure is covered by a plastics sheeting material 41 which extends from a rear edge 42 across the full width of the shelf to a front edge 43 where the plastics material is bent upwardly as indicated at 44 to provide a front lip projecting upwardly to a height sufficient to prevent articles from toppling over the front edge.

The plastics material is selected so that it has a low co-efficient of friction allowing the articles to slide readily on the shelf with the minimum angle B of inclination.

The wire mesh forming the shelf is stiffened by a plurality of transverse stiffening members 45 and longitudinal stiffening members 46. The longitudinal stiffening members 46 correspond to the straps 11F of the previous embodiment and can be formed simply a flat surface 46A which corresponds to the strap 11F. However in the embodiment shown, to provide increased structural rigidity, the stiffener member 46 is formed as a V shaped with one leg 46A standing in a vertical plane and a second leg 46B extending at right angles to the shelf. The V-shaped member is welded at its upper edges to the wires 39 so as to rigidly attach thereto and to provide structural strength therefor. Alternative stiffener members can be used including tubes, U channels, angles and the like.

The transverse stiffener members 45 can also be provided by various different types of element including angle irons, flat straps, square tubes and round tubes. In the embodiment shown, the stiffener member 45 is formed from a round tube 50 with a rear end 51 welded to the face of the leg 46B. The forward end of the tube 50 extends to a position within the receptacle 34 of the front beam 33A underneath the front edge of the shelf. In order to reduce the height of the stiffener member, the tubing forming the stiffener member 50 is flattened as indicated at 50A so as to form a wide flat edge 50B sitting directly on the receptacle 34. In order to strengthen the tube 50 when flattened a second smaller tube portion 50B can be inserted inside the first tube 50 over the flattened area thus forming a simple inexpensive stiffener member which provides sufficient rigidity across the full width of the shelf from the front edge at the receptacle 34 to the rear edge adjacent the surface of the leg 46A.

As described in the previous embodiment, the ends 46D of the stiffener member 46 project outwardly beyond the ends of the shelf into engagement with a front surface 31A of the posts 31. Thus the rigid flat shelf is wedged in position between the receptacle 34 of the front beam 33A and the edges of the stiffener member which abut onto the surface 31A of the post 31. Thus the shelf is held in place by its pressure into the receptacle 34 at the front and by its frictional engagement with the surface 31A at the rear. Thus the shelves can be simply dropped into place by pressing the nose or front edge into the front beam and dropping the rear edge onto the posts 31. The shelves remain planar without bending due to the structural rigidity of the stiffeners and the weight of articles on the shelf tend to press the ends of the shelf more vigorously into engagement with the surfaces of the frame.

The plastics sheet member 41 can be omitted and the top wires arranged to run in the direction of sliding since in some cases this can provide a lower friction than the sheet.

Figure 7:
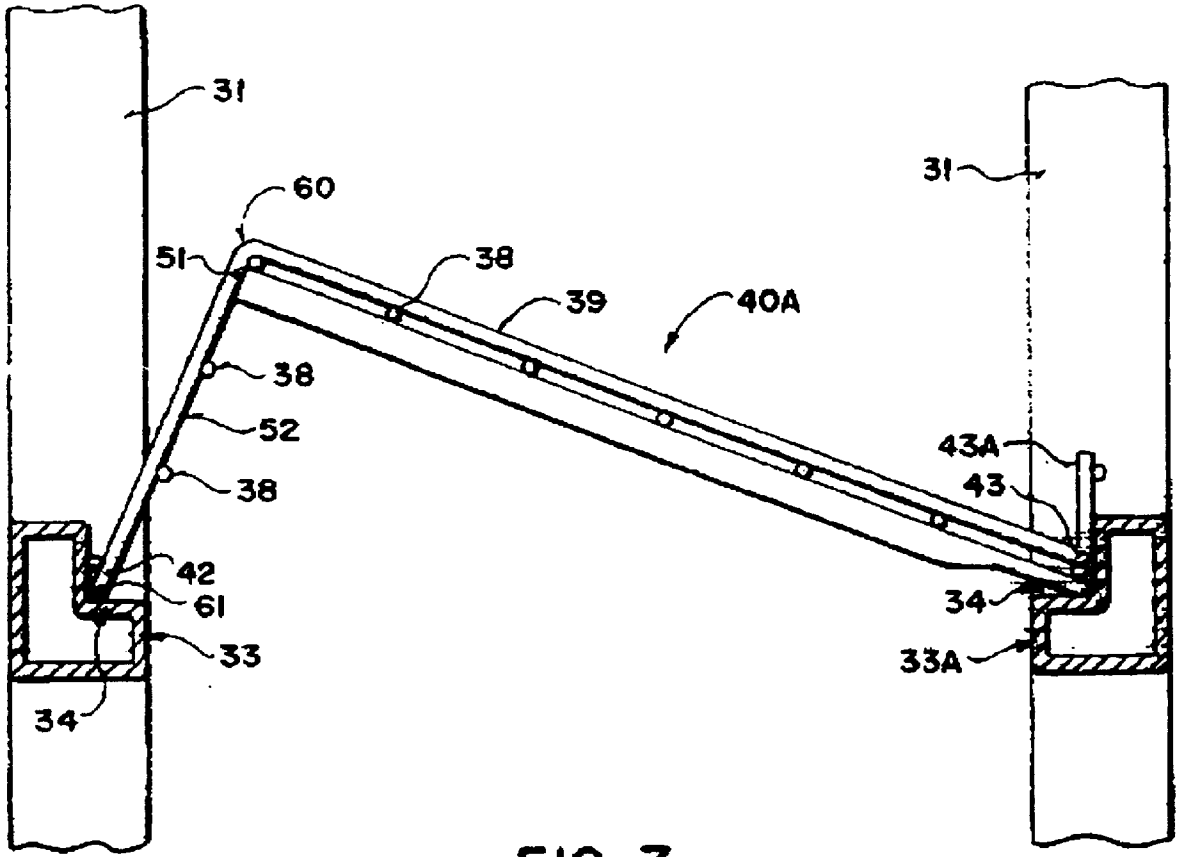
FIG. 7 is a cross sectional view similar to that of FIG. 2 showing a third embodiment.
Figure 8:
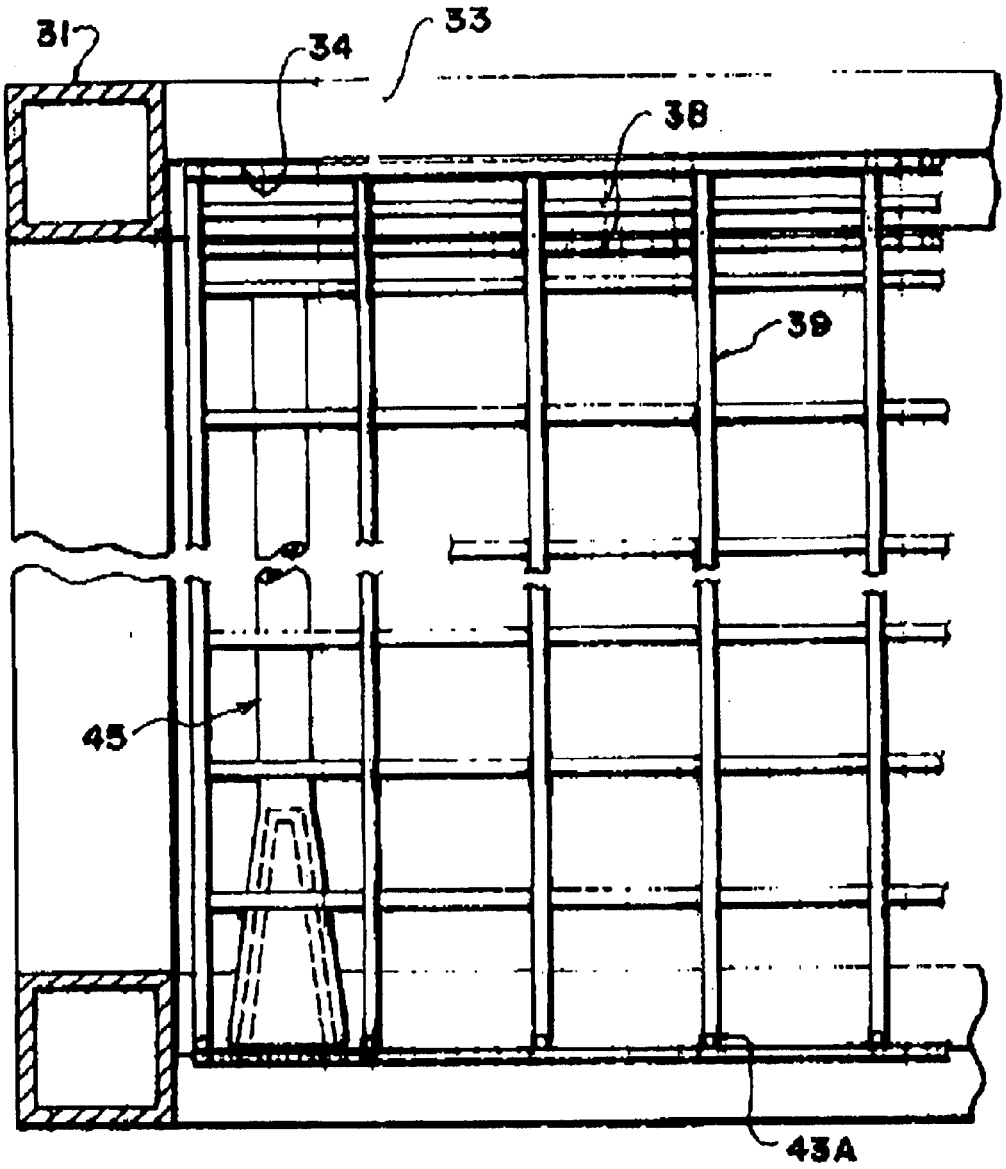
FIG. 8 is plan view of the embodiment shown in FIG. 7.

Turning now to FIGS. 7 and 8, there is shown a construction which is similar in many respects to that shown in FIGS. 5 and 6 in that it includes a shelf structure 40A formed of longitudinal wires 38 and transverse wires 39 welded to form a mesh structure extending from a rear edge 42 through a front edge 43. In this embodiment, the plastics covering sheet 41 previously described is omitted and instead the top wires are arranged in the forward direction to allow sliding forwardly. In this embodiment, the articles are prevented from toppling from the front edge by an upturned front edge 43A. The shelf co-operates with a frame structure of the type previously described including the posts 31 and the shelf support beams 33 and 33A.

Yet further the shelf includes the tubular stiffener members 45 which extend from the flattened front edge as previously described to a rear edge 51.

However in this embodiment the mesh formed by the wires 38 and 39 is bent at an apex 60 to an angle lying between approximately 80° and approximately 110° and preferably slightly greater than 90° so as to form a turn down portion 52 of the wire mesh. This turned down portion is formed by the same wire structure including the wires 38 which extend longitudinally of the shelf and the wires 39 which bend around the apex 60 to form a lowermost edge 61 which projects into the receptacle 34 on the beam 33. Thus the weight from the shelf is applied through the turned down portion 52 into the rear receptacle of the rear beam 33 and at the same time the weight is pushed forwardly into the receptacle 34 of the front beam 33A. As the height of the turned down portion 52 is relatively small and may be of the order of 4 to 5 inches but may be as much as 7 or 8 inches, the wire mesh itself may provide sufficient strength without bending to accommodate the forces on the shelf. However if necessary an additional stiffener element similar to the stiffening element 45 may be provided extending from the apex 60 to the receptacle 34.

Figure 9:
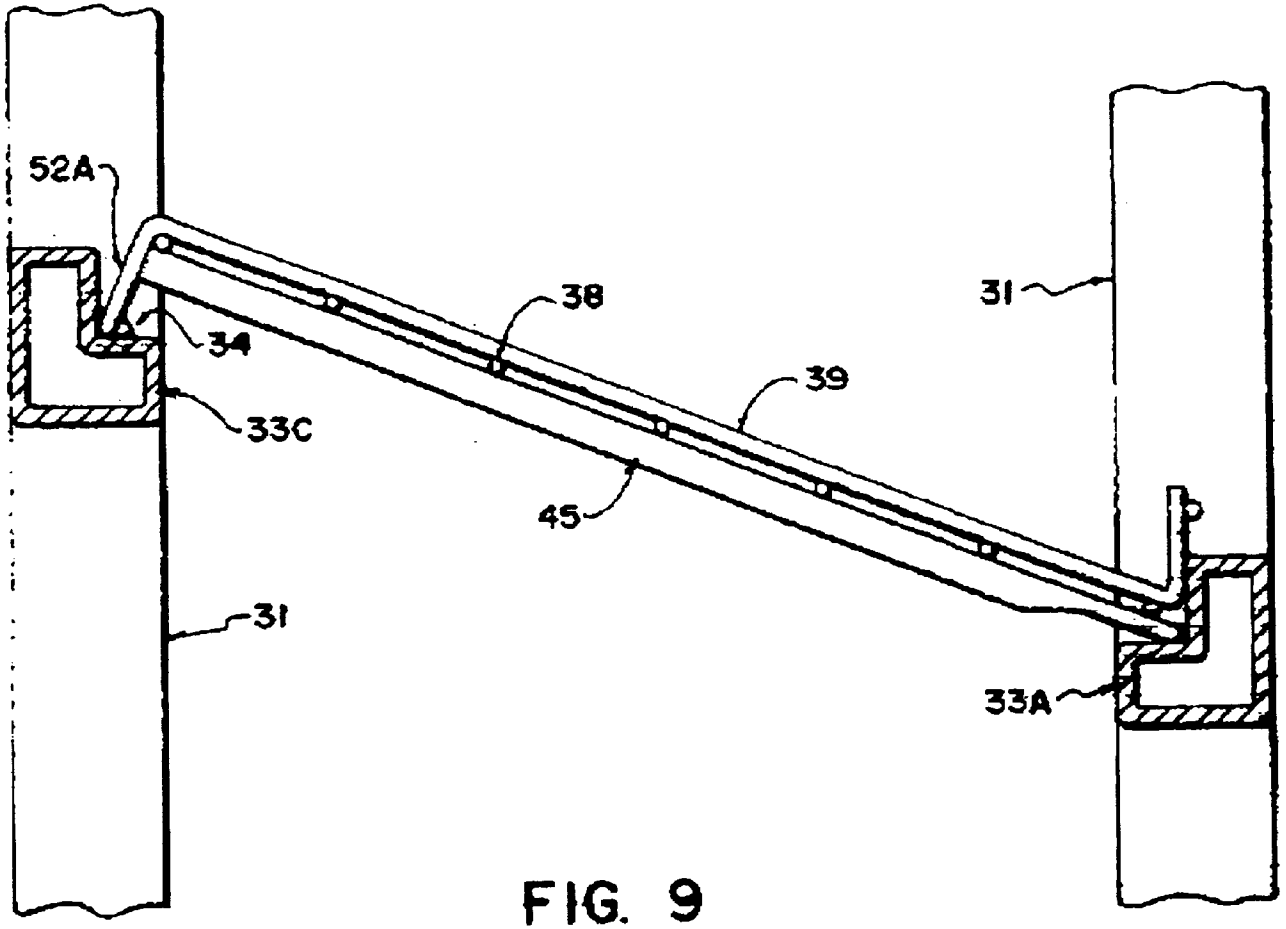
FIG. 9 is a cross sectional view similar to that of FIG. 2 showing a fourth embodiment.

Turning now to the arrangement shown in FIG. 9, it is very similar to the construction shown in FIGS. 7 and 8 except that in this arrangement the rear shelf support beam 33C is arranged at a height above the front shelf support beam 33A. This can be achieved using the conventional frame structure of the type previously described by locating the rear beam 33C in a respective locating position on the post 31. Thus the posts 31 provide a series of locating positions for locating the shelves at different heights and it is possible therefore to select for the front beam 33A a different location on the beam 31 at the front as opposed to the selection of the position of the rear beam 33C on the rear post 31. Thus the shelf structure is substantially the same as previously described in regard to FIG. 7 including the stiffener member 45, the wires 38 and 39. In this arrangement, however, the turned down portion 52A is of a reduced height relative to the portion 52 of FIG. 7 since the raised rear beam 33C provides a part of the angle of inclination necessary for the shelf. Thus the turned down portion 52A may be of the order of 1 to 2" in height only which is sufficient to communicate forces from the weight of material on the shelf downwardly and rearwardly into the receptacle 34 of the rear beam and forwardly and downwardly into the receptacle 34 of the front beam.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

What is claimed is:

1. A shelving rack comprising:

a frame structure including two generally vertical rear legs and two generally vertical front legs with the front legs arranged at a front of the rack and spaced by a width of the rack and the rear legs arranged at the rear of the rack and spaced by the width of the rack, the front legs being spaced from the rear legs by a depth of the rack;

a plurality of shelves arranged above one another and each having a width substantially equal to the width of the rack and a depth between a front edge and a rear edge substantially equal to the depth of the rack;

each shelf being supported at the front edge by a respective one of a plurality of front transverse shelf support beams connected across the front legs so the weight from the front edge of each shelf is carried by the front legs;

each shelf being formed from a generally planar shelf material;

each shelf having a shelf plane being inclined upwardly and rearwardly from the front edge toward the rear edge;

each shelf being supported at the rear edge by a respective one of a plurality of rear transverse shelf support beams connected across the rear legs so the weight from the rear edge of each shelf is carried by the rear legs;

each of the front support beams including a front support receptacle for the respective edge of the respective shelf, each front support receptacle being formed by a horizontal surface and a rearwardly facing vertical surface forming a right angle therebetween;

each of the rear support beams including a rear support receptacle for the respective edge of the respective shelf, each rear support receptacle being formed by a horizontal surface and a forwardly facing vertical surface forming a right angle therebetween;

the front edge of each shelf engaging into the respective front support receptacle of the respective front support beam each shelf having the shelf material thereof bent adjacent a rear edge thereof to form a main shelf portion extending from the receptacle of the respective front beam upwardly and rearwardly to an apex and a downwardly turned rear edge portion extending across the width of the shelf and arranged at an angle to the shelf plane so as to extend downwardly from the apex;

the shelf including the main shelf portion, the apex and the rear edge portion formed from the shelf material which is bent at the apex;

the apex being spaced above the respective front beam and spaced above the respective rear beam such that the rear edge portion extends downwardly from a position spaced above the respective rear beam at the apex;

and each shelf having the rear edge thereof at the bottom of the rear edge portion engaging into the respective rear receptacle of the respective rear support beam.

2. The shelving rack according to claim 1, wherein each shelf includes a plurality of stiffener members each extending from the front edge to the downwardly turned rear edge portion, the stiffener members being arranged at positions spaced across the width of the shelf.

3. The shelving rack according to claim 2 wherein each stiffener member is of reduced height at the front edge of the respective shelf to engage into the respective front receptacle of the respective front support beam.

4. The shelving rack according to claim 1 wherein each rear support beam is located at a height above the respective front support beam.

5. A shelving rack comprising:

a frame structure including two generally vertical rear legs and two generally vertical front legs with the front legs arranged at a front of the rack and spaced by a width of the rack and the rear legs arranged at the rear of the rack and spaced by the width of the rack, the front legs being spaced from the rear legs by a depth of the rack;

a plurality of shelves arranged above one another and each having a width substantially equal to the width of the rack and a depth between a front edge and a rear edge substantially equal to the depth of the rack;

each shelf being supported at the front edge by a respective one of a plurality of front transverse shelf support beams connected across the front legs so the weight from the front edge of each shelf is carried by the front legs;

each shelf having a shelf plane being inclined upwardly and rearwardly from the front edge toward the rear edge;

each shelf being supported at the rear edge by a respective one of a plurality of rear transverse shelf support beams connected across the rear legs so the weight from the rear edge of each shelf is carried by the rear legs;

each of the front support beams including a front support receptacle for the respective edge of the respective shelf, each front support receptacle being formed by a horizontal surface and a rearwardly facing vertical surface forming a right angle therebetween;

each of the rear support beams including a rear support receptacle for the respective edge of the respective shelf, each rear support receptacle being formed by a horizontal surface and a forwardly facing vertical surface forming a right angle therebetween;

the front edge of each shelf engaging into the respective front support receptacle of the respective front support beam each shelf being formed from wire mesh with longitudinal wires extending across the depth of the shelf from the front edge to the rear edge and transverse wires extending across the width of the shelf;

each shelf having the longitudinal wires thereof bent adjacent a rear edge of the shelf to form a downwardly turned rear edge portion of the shelf extending across the width of the shelf and arranged at an angle to the shelf plane so as to extend downwardly from the shelf plane;

and each shelf having the longitudinal wires at the rear edge thereof at the bottom of the rear edge portion engaging into the respective rear receptacle of the respective rear support beam.

6. The shelving rack according to claim 5 wherein the transverse wires of each shelf includes a plurality of stiffener members each extending from the front edge to the downwardly turned rear edge portion, the stiffener members being arranged at positions spaced across the width of the shelf.

7. The shelving rack according to claim 6 wherein each stiffener member is of reduced height at the front edge of the respective shelf to engage into the respective front receptacle of the respective front support beam.

8. The shelving rack according to claim 5 wherein each rear support beam is located at a height above the respective front support beam.

* * * * *